US011776347B2

(12) United States Patent
Hoeschen

(10) Patent No.: US 11,776,347 B2
(45) Date of Patent: Oct. 3, 2023

(54) DEVICE FOR HANDLING NOTES OF VALUE AND METHOD FOR OPERATING A DEVICE FOR HANDLING NOTES OF VALUE

(71) Applicant: Wincor Nixdorf International GmbH, Paderborn (DE)

(72) Inventor: Hermann Hoeschen, Paderborn (DE)

(73) Assignee: DIEBOLD NIXDORF SYSTEMS GMBH, Paderborn (DE)

( * ) Notice: Subject to any disclaimer, the term of this patent is extended or adjusted under 35 U.S.C. 154(b) by 0 days.

(21) Appl. No.: 17/625,234

(22) PCT Filed: Jul. 6, 2020

(86) PCT No.: PCT/EP2020/068933
§ 371 (c)(1),
(2) Date: Jan. 6, 2022

(87) PCT Pub. No.: WO2021/008910
PCT Pub. Date: Jan. 21, 2021

(65) Prior Publication Data

US 2022/0270427 A1 Aug. 25, 2022

(30) Foreign Application Priority Data

Jul. 12, 2019 (EP) ..... 19185941

(51) Int. Cl.
*G07D 11/30* (2019.01)
*G07D 11/50* (2019.01)
(Continued)

(52) U.S. Cl.
CPC ..... *G07D 11/30* (2019.01); *G07D 11/23* (2019.01); *G07D 11/24* (2019.01); *G07D 11/34* (2019.01); *G07D 11/50* (2019.01)

(58) Field of Classification Search
CPC ..... G07D 11/30; G07D 11/23; G07D 11/24; G07D 11/34; G07D 11/50
See application file for complete search history.

(56) References Cited

U.S. PATENT DOCUMENTS 7,967,191 B1 6/2011 Enright
7,980,461 B1 * 7/2011 Enright ..... G07F 19/20 270/58.11

(Continued)

FOREIGN PATENT DOCUMENTS

JP H03115040 A 5/1991
WO 2016059844 A1 4/2016

OTHER PUBLICATIONS

International Search Report filed in the corresponding PCT Application dated Sep. 9, 2020; 4 pages.

(Continued)

*Primary Examiner* — Sonji N Johnson
(74) *Attorney, Agent, or Firm* — Black McCuskey

(57) ABSTRACT

The device comprises an input compartment for inputting notes of value, a pull-off and separating unit for separating the notes, a value note identification unit for identifying the separated notes. The device comprises a cash box for storing notes. A control unit determines whether a filling level of the cash box has reached or exceeded a predetermined value. The control unit determines a remaining capacity of the cash box. The control unit deducts the number of notes transported to the cash box from the remaining capacity after a predetermined fill level of the cash box has been reached.

7 Claims, 6 Drawing Sheets

(51) Int. Cl.

| | |
|---|---|
| ***G07D 11/23*** | (2019.01) |
| ***G07D 11/24*** | (2019.01) |
| ***G07D 11/34*** | (2019.01) |

(56) References Cited

U.S. PATENT DOCUMENTS

| | | | | |
|---|---|---|---|---|
| 2009/0055017 | A1 | 2/2009 | Langlotz | |
| 2013/0047869 | A1* | 2/2013 | Kataoka | G07D 11/16 194/302 |
| 2016/0325961 | A1* | 11/2016 | Kojima | B65H 29/52 |
| 2019/0218052 | A1* | 7/2019 | Takemura | B65H 29/46 |

OTHER PUBLICATIONS

Written Opinion filed in the corresponding PCT Application dated Sep. 9, 2020; 7 pages.
International Report on Patentability filed in the corresponding PCT Application dated Jan. 18, 2022; 8 pages.

* cited by examiner

| FIG. 2-1 | FIG. 2-2 |
|---|---|

DEVICE FOR HANDLING NOTES OF VALUE AND METHOD FOR OPERATING A DEVICE FOR HANDLING NOTES OF VALUE

CROSS-REFERENCE TO RELATED APPLICATIONS

This application is a National Phase filing of International Application Ser. No. PCT/EP2020/068933, for a DEVICE FOR HANDLING NOTES OF VALUE AND METHOD FOR OPERATING A DEVICE FOR HANDLING NOTES OF VALUE, filed 2020 Jul. 6, which claims priority to EP19185941.2, filed 2019 Jul. 12, both applications are hereby incorporated by reference in their entireties.

BACKGROUND AND SUMMARY

The invention relates to a device for handling notes of value with an input compartment for inputting notes of value, with a pull-off and separating unit for separating the notes of value present in the input compartment, with a value note identification unit for identifying the separated notes of value, with an intermediate storage unit for intermediately storing the identified notes of value, with a first cash box for storing notes of value, with a second cash box for storing notes of value, with a transport unit for transporting notes of value between the afore-mentioned units and cash boxes, and with a control unit. The control unit is configured to assign one of the two cash boxes as a target cash box to each of the identified notes of value and to determine whether the filling level of the second cash box has reached or exceeded a predetermined value. The control unit is further configured to control the transport unit such that all notes of value provided to the device are fed to the intermediate storage and are intermediately stored therein, and that intermediately stored notes of value that are to be stored in the first cash box are removed from the intermediate storage unit, are fed to the first cash box and are stored therein.

The invention further relates to a method for operating a device for handling notes of value in which notes of value provided to the device are separated, in which the separated notes of value are identified, in which the identified notes of value are intermediately stored, in which a first cash box or a second cash box is assigned as a target cash box to each identified note of value, in which it is determined whether the filling level of the second cash box has reached or exceeded a predetermined value, and in which all notes of value that are to be stored in the first cash box are fed to the first cash box and stored therein.

Known devices for handling notes of value have so-called all-in boxes in which, for example, deposited notes of value are stored that are not recycled, i.e. that are fed to the device via an input compartment but are not dispensed again. Such all-in boxes have a sensor determining whether the all-in box has reached a predetermined filling level. The sensor is arranged such that, after the sensor has been triggered, at least still the maximum content of an intermediate storage unit for intermediately storing notes of value during a deposit operation can be stored in the all-in box. After reaching the filling level detected by the sensor, deposit operations are no longer possible since it can no longer be guaranteed that all notes of value stored in the intermediate storage can subsequently be accommodated in the all-in box, i.e. no notes of value remain in the intermediate storage. In the worst case, this means that a large part of the capacity of the all-in box remains unused.

For example, the capacity of the all-in box is 4000 notes of value, and the capacity of the intermediate storage unit is 350 notes of value. So that also notes of value having a poor quality, i.e. for example extremely wavy notes of value, find enough space in the all-in box, the sensor is adjusted such that, after the sensor has been triggered, still about 400 notes of value may be accommodated in the all-in box. If, after the sensor has been triggered, only one note of value is still transported into the all-in box, space for 399 notes of value remains unused in the all-in box.

It is the object of the invention to specify a device for handling notes of value and a method for operating such a device, in which it can reliably be prevented that notes of value remain in an intermediate storage in deposit operations.

This object is solved by a device and a method as disclosed herein.

In an exemplary device, the control unit is configured to determine a remaining capacity of the second cash box in that the control unit deducts the number of notes of value that have altogether been stored in the second cash box, after the filling level of the second cash box has reached or exceeded the predetermined value, from an initial remaining capacity stored in a preset manner. Further, when the number of intermediately stored notes of value that are to be stored in the second cash box does not exceed the remaining capacity, the control unit is configured to control the transport unit such that the notes of value that are to be stored in the second cash box are removed from the intermediate storage unit, are fed to the second cash box and are stored therein.

The initial remaining capacity stored in a preset manner is preferably stored in a memory element of the control unit. Preferably, the notes of value that are stored in the second cash box are not recycled, i.e. are not dispensed to customers again.

In the exemplary device, the actual remaining capacity of the second cash box is determined after the filling level of the second cash box has reached or exceeded the predetermined value. Before notes of value are stored in the second cash box, it is checked whether the number of notes of value that are to be stored in the second cash box is smaller than the remaining capacity. As a result, it is reliably prevented that during deposit operations notes of value which, for reasons of capacity, cannot be accommodated in the second cash box are accepted in the intermediate storage. At the same time, the value note storage capacity of the second cash box is optimally utilized.

It is advantageous when the device comprises a display unit. Further, it is advantageous when the control unit is configured to output an error message on the display unit when the number of notes of value that are stored in the intermediate storage and that are to be stored in the second cash box exceeds the remaining capacity, and to control the transport unit such that all notes of value intermediately stored in the intermediate storage are removed from the intermediate storage unit and are fed to the input compartment. This error message may in particular be a standard error message, for example a message according to which the intermediate storage unit is full.

Alternatively or additionally, when the number of notes of value that are stored in the intermediate storage and that are to be stored in the second cash box has reached the remaining capacity, the control unit is configured to control the transport unit such that further notes of value already taken from the input compartment and not yet fed to the intermediate storage unit are transported back to the input compartment. This guarantees that the notes of value that can no longer be stored in the second cash box are immediately transported back to the input compartment. The notes of value already stored in the intermediate storage unit may remain in the intermediate storage unit and are subsequently, in particular after receipt of a confirmation information transported with the aid of the transport unit into the respective cash box in which they are to be stored. As a result, the value note storage capacity of the second cash box may be utilized even better.

It is advantageous when the control unit is configured to control the transport unit such that the intermediately stored notes of value are only removed from the intermediate storage unit after receipt of a confirmation information, are fed to their respective target box and are stored therein. In this embodiment, at first all identified notes of value are intermediately stored and, for example with the aid of the display unit, a confirmation information is prompted. The confirmation information may be input via an input unit. When the control unit determines a negative confirmation information, i.e. when the deposit operation shall be cancelled, preferably all notes of value intermediately stored in the intermediate storage are transported back to the input compartment and provided for removal. As a result, a user is able to check, for example, the value and/or the amount of the input notes of value. When the control unit determines a positive confirmation information, the deposit operation is terminated by the storage of the notes of value in their respective target boxes.

It is advantageous when the second cash box comprises a detector element that is configured to determine whether the filling level of the second cash box has reached or exceeded the predetermined value. The detector element may be a light barrier arrangement and/or a detection lever. With the aid of the detector element, in particular the reaching of a certain filling height or filling level of the value note stack accepted in the second cash box is determined. As a result, a reliable detection of the filling level value to be detected is possible with the aid of cost-efficient units.

It is particularly advantageous when the notes of value are storable or are stored in the first cash box such that they stand on one of their edges and in the second cash box such that they lie on their front or back.

Up to the reaching of the predetermined value that is detectable with the aid of the detector element, the remaining capacity of the second cash box is so high that the maximum number of notes of value storable in the intermediate storage can be accommodated in the second cash box. Thus, up to the reaching of this value, no further measure has to be taken so that it is guaranteed that all notes of value accepted in the intermediate storage can actually be accommodated in the intended cash box. Thus, it is guaranteed that even when all notes of value stored in the intermediate storage are to be stored in the second cash box, these can actually be stored in the second value note box.

It is advantageous when the initial remaining capacity, stored in a present manner as a limit value, is less than or equal to the number of notes of value intermediately stored in the intermediate storage unit. As a result, it is guaranteed that the analysis of the remaining capacity of the second cash box is only performed when the preset limit value has been reached or fallen below, since all notes of value intermediately storable in the intermediate storage can no longer be stored in the second cash box alone when the limit value has been reached or fallen below. As a result, a simple analysis and a resource-poor execution of the required steps by the control unit is possible.

A second aspect of the invention relates to a method of the type mentioned at the beginning, in which a remaining capacity of the second cash box is determined in that the number of notes of value altogether stored in the second cash box, after the filling level of the second cash box has reached or exceeded the predetermined value, is deducted from an initial remaining capacity stored in a preset manner. Further, when the number of intermediately stored notes of value which are to be stored in the second cash box does not exceed the remaining capacity, the notes of value which are to be stored in the second cash box are fed to the second cash box and stored therein.

The method has the same advantages as the device and may be developed in the same manner, in particular with the features as disclosed herein.

In a preferred embodiment, it is determined, after intermediately storing the identified notes of value, whether the filling level of the second cash box has reached or exceeded the predetermined value. When the filling level of the second cash box has reached or exceeded a predetermined value, it is determined whether the number of notes of value that are to be stored in the second cash box is greater than the stored remaining capacity. Further, when the number of notes of value that are to be stored in the second cash box is not greater than the remaining capacity, the notes of value that are to be stored in the second cash box are fed to the second cash box and stored therein. In a preferred embodiment, an error message is output when the number of notes of value that are to be stored in the second cash box is higher than the remaining capacity. As a result, an easy operation of the device for handling notes of value is possible.

It is advantageous when, after intermediately storing the identified notes of value, it is determined whether the filling level of the second cash box has reached or exceeded a predetermined value. When the filling level of the second cash box has not reached or exceeded the predetermined value, each note of value which is to be stored in the second cash box is individually fed to the second cash box and stored therein. Further, upon storage of each note of value in the second cash box, it is determined whether the filling level of the second cash box has reached or exceeded the predetermined value. As a result, a reliable operation of the device for handling notes of value is guaranteed, and the capacity of the second cash box may be utilized much better than in the prior art, as a result whereof the device has to be taken out of service only at a later point in time or not at all.

In a preferred embodiment, the intermediately stored notes of value are only fed to their respective target box and stored therein after receipt of a confirmation information. This guarantees that a user can cancel the deposit operation by non-input of the confirmation information or by input of a cancellation information. It is particularly advantageous when the user has previously been informed with the aid of the display unit about details of the deposit, such as the total sum, the denomination of the deposited notes of value and/or the currency/currencies of the deposited notes of value and is in particular prompted to confirm a previously determined total sum of deposited notes of value.

The filling level of a cash box is preferably the length of the value note stack accommodated in a storage area of the cash box in stacking direction. When the value note stack fills the storage area, the maximum filling level is reached.

BRIEF DESCRIPTION OF THE DRAWINGS

Further features and advantages of the invention result from the following description which explains the invention in more detail in connection with the enclosed figures on the basis of embodiments.

FIGS. 2-1 and 2-2 shows a flow chart of a deposit operation.

DETAILED DESCRIPTION

Figure 1:
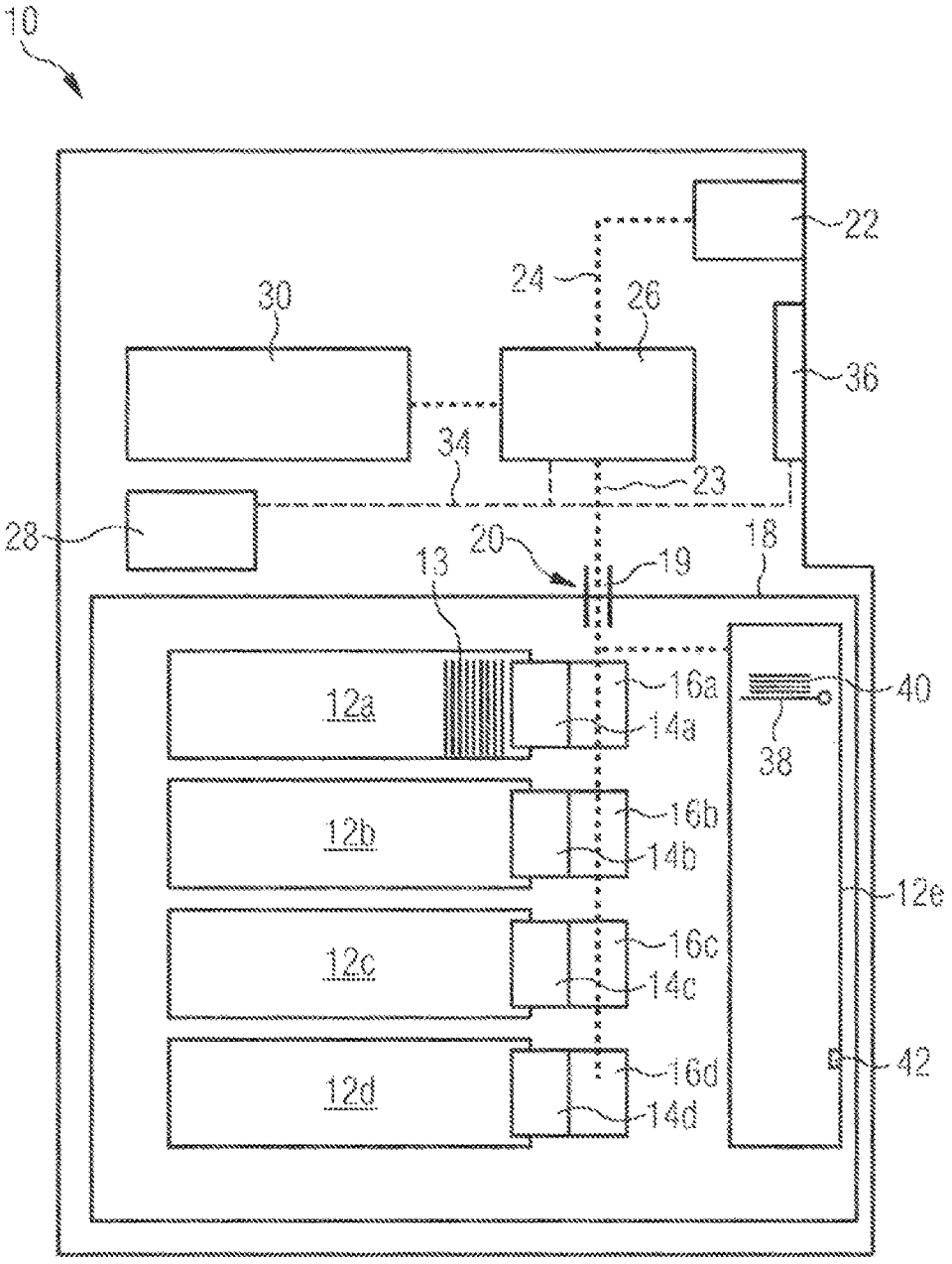
FIG. 1 shows a schematic illustration of an automated teller machine.

In FIG. 1, a schematic illustration of an automated teller machine 10 is shown. The automated teller machine 10 serves both for the deposit of banknotes by a user and for the withdrawal of banknotes by a user. Such an automated teller machine 10 which serves both for the deposit and for the withdrawal of banknotes is also referred to as recycling automated teller machine. Alternatively, the automated teller machine 10 may also exclusively serve for the deposit of banknotes. Further, the specified method and the specified device may also be used in other banknote handling devices, in particular in automatic cash register systems and so-called automatic cash safes.

The automated teller machine 10 comprises a safe 18 in which altogether five cash boxes 12*a* to 12*e* are arranged and which protects the cash boxes 12*a* to 12*e* against unauthorized access, in particular against theft and manipulation attempts. The cash boxes 12*a* to 12*e* serve to store and transport banknotes. The banknotes are stored in the cash boxes 12*a* to 12*e* in the form of a stack, wherein the banknotes are arranged such that they stand on one of their edges, in particular one of their longitudinal edges. One of these stacks is exemplarily indicated in the first cash box 12*a*. One of these banknotes of this banknote stack is exemplarily identified with the reference sign 13.

In the cash boxes 12*a* to 12*d*, the banknotes 13 are preferably type-specific or mixed with two denominations. The banknotes 13 of the cash boxes 12*a* to 12*d* in particular serve for the withdrawal by a user. In particular, at least one of the cash boxes 12*a* to 12*d*, preferably all four cash boxes 12*a* to 12*d*, serves as a recycling box in which deposited banknotes are stored and are subsequently removed from the cash box 12*a* to 12*d* for withdrawals.

Each cash box 12*a* to 12*d* has one respective opening for feeding banknotes 13 and for removing banknotes 13. In front of the opening of a cash box 12*a* to 12*d*, a respective separating and stacking unit 14*a* to 14*d* is arranged, with the aid of which, on the one hand, banknotes 13 can be fed to the cash boxes 12*a* to 12*d* and, on the other hand, banknotes 13 stored in the cash boxes 12*a* to 12*d* can each time be separated from the banknote stacks respectively received in the cash boxes 12*a* to 12*d* and can be removed from the cash boxes 12*a* to 12*d*.

In front of each separating and stacking unit 14*a* to 14*d*, one respective switch 16*a* to 16*d* is arranged, with the aid of which a banknote 13 transported along a transport path 19 and to be fed to one of the cash boxes 12*a* to 12*d* is branched off the transport path 19 and fed to that separating and stacking unit 14*a* to 14*d* that is arranged in front of the respective cash box 12*a* to 12*d* into which the banknote 13 is to be transported. Likewise, the switches 16*a* to 16*d* serve for the transport of banknotes 13 removed from the cash boxes 12*a* to 12*d* with the aid of the separating and stacking unit 14*a* to 14*d* on the transport path 19. The safe 18 has an opening 20 through which the banknotes 13 transported along the transport path 19 are feedable to the safe 18 or are transportable out of the safe 18.

Further, the automated teller machine 10 comprises an input and output compartment 22 via which banknotes 13, 40 to be deposited are input into the automated teller machine 10 by a user, and banknotes 13 to be dispensed can be output to a user. In a withdrawal-only automated teller machine, only the withdrawal of banknotes 13 takes place via the input and output compartment 22, in a deposit-only automated teller machine only the deposit of banknotes 13, 40 takes place via the input and output compartment 22. The banknotes 13, 40 are transportable with the aid of a first transport unit 24 between the input and output compartment 22 and a value note identification unit 26. The first transport unit 24 preferably comprises at least one roll, at least one roller and/or at least one transport belt. Preferably, the rolls, the rollers and the transport belts are arranged in pairs, so that the banknotes 13 to be transported are each time transported between the rolls of a pair of rolls or the rollers of a pair of rollers or the belts of a pair of belts. The transport of banknotes 13 along the transport path 19 from the value note identification unit 26 to the cash boxes 12*a* to 12*e* or from the cash boxes 12*a* to 12*e* to the value note identification unit 26 takes place with the aid of a second transport unit. The second transport unit 23 likewise preferably comprises at least one roll, at least one roller and/or at least one transport belt.

The banknotes 13 deposited via the input and output compartment 22 are separated and with the aid of the first transport unit 24 individually fed to the value note identification unit 26, with the aid of which the authenticity of the deposited banknotes 13 and the denomination of each deposited banknote 13 are determined. Dependent at least on the determined authenticity and the determined denomination of the banknote 13, this banknote 13 is assigned to one of the cash boxes 12*a* to 12*e* by the control unit 28. In the cash box 12*e*, at least banknotes 13 suspected to be counterfeit and banknotes 13 which due to their denomination are not intended for withdrawal again are stored. In the Eurozone, only banknotes having a denomination of £ EUR 100 are dispensed by automated teller machines 10. Deposited EUR 200 and EUR 500 banknotes are not dispensed again and thus stored in the cash box 12*e*. The cash box 12*e* is also referred to as deposit cash box or all-in box. Since the banknotes 13 received in the cash box 12*e* are not dispensed again, the cash box 12*e* is only configured such that it can accept banknotes 13.

The cash boxes 12*a* to 12*d* are preferably so-called recycling boxes, to which both banknotes 13 may be fed and from which banknotes 24 may be removed. In the first recycling box 12*a* only banknotes 13 with a first denomination are stored. Such a storage of banknotes 13 of only one denomination in a cash box 12*a* to 12*d* is referred to as type-specific storage. In the second recycling box 12*b*, banknotes with a second denomination and banknotes with a third denomination are stored. In the third recycling box 12*c*, banknotes with a third denomination and banknotes with a fourth denomination are stored and in the fourth recycling box 12*d* only banknotes with the fourth denomination are stored. For example, the automated teller machine 10 handles Euro banknotes. In this case, in particular in the first recycling box 12*a* EUR 5 banknotes, in the second recycling box 12*b* EUR 10 and EUR 20 banknotes, and in the third recycling box 12*c* EUR 20 and EUR 50 banknotes as well as in the fourth cash box 12*d* only EUR 50 banknotes are stored. EUR 100 banknotes are not dispensed in the embodiment according to FIG. 1. Deposited EUR 100 banknotes are fed to the all-in box 12*e*. The storage of banknotes 13 of different denominations in one cash box 12*b*, 12*c* and 12*e* is also referred to as mixed-storage. Alternatively, also another allocation of the denominations of the banknotes 13 to the individual cash boxes 12*a* to 12*e* is conceivable.

When banknotes 13 are dispensed, a user inputs with the aid of an input and output unit 36, in particular with the aid of a touch screen, which amount of money the user wishes to withdraw. With the aid of a control unit 28, which is connected to the input and output unit 36 via a data line 34, it is determined which banknotes 13 are required in order to output the desired amount of money via the input and output compartment 22 to the user. The banknotes 13 to be dispensed are removed from the recycling boxes 12*a* to 12*d* and are transported with the aid of the first transport unit 24 and the second transport unit 23 into the input and output compartment 19.

The cash box 12*e* serves, as already mentioned, as a so-called all-in box in which deposited banknotes are stored that either for reasons of capacity cannot be stored in the cash boxes 12*a* to 12*d*, namely in particular when the cash boxes 12*a* to 12*d* in which a deposited note of value is to be stored due to its denomination and currency is full, or when a deposited note of value is not to be stored in one of the cash boxes 12*a* to 12*d* due to its denomination and/or currency. Further, in the cash box 12*e* other notes of value, such as checks or vouchers, may be stored. Also deposited notes of value which due to their quality properties in particular due to contamination and/or damage shall not be dispensed again, may be stored in the cash box 12*e*.

The banknotes and other notes of value are stored in the cash box 12*e* in the form of a stack, the banknotes being placed on a carriage 38 in a lying position. In FIG. 1, a banknote of the banknote stack placed on the carriage 38 is identified with the reference sign 40. With the aid of a non-illustrated drive unit, the carriage 38 can be displaced from an upper position downward such that in the upper area of the cash box 12*e* a feed gap for feeding further notes of value remains. The cash box 12*e* has a detector 42 which detects the carriage 38 as soon as it arrives in the area of the detector 42.

The detector 42 is in particular a sensor, which preferably comprises a light barrier arrangement which, upon arrival of the carriage 38, experiences a change of state, in particular the light beam is interrupted or enabled when the carriage 38 arrives at the area of the sensor 42. After the carriage 38 has been detected by the detection unit 42, the cash box 12*e* has a remaining capacity of, for example, 400 banknotes. The total capacity of the cash box 12*e* may, for example, be 4000 banknotes in such a case. It is particularly advantageous when the remaining capacity of the cash box 12*e*, after detection of the carriage 38 by the detector 42, corresponds to the maximum storage capacity of the intermediate storage 30.

Deposited banknotes and notes of value which are fed to the automated teller machine 10 via the input and output compartment 22, are individually fed to the intermediate storage 30 after separation and passing by the value note identification unit 26. After storage of all deposited banknotes in the intermediate storage 30, a user is provided with information on all deposited banknotes via the input and output unit 36. In particular, the total amount and/or the number and the denominations of all deposited banknotes is output to the user. Subsequently, the user may cancel the deposit operation, whereupon all banknotes are removed from the intermediate storage and are deposited in the input and output compartment 22 so that the user may again remove all deposited banknotes.

If, on the other hand, the user confirms via the input and output unit 36 that the user wishes to continue the deposit operation, the banknotes stored in the intermediate storage 30 are actually fed to a cash box 12*a* to 12*e* previously determined by the control unit 28. This procedure guarantees that even when all deposited banknotes would have to be transported into the cash box serving as all-in box 12*e*, there is enough capacity in the all-in box for storing the banknotes present in the intermediate storage 30. Since, for example, the remaining capacity of the cash box 12*e* after detecting the carriage 38 by the detector 42 is 400 banknotes, the maximum capacity of the intermediate storage may also be 400 banknotes. In other automated teller machines 10 intermediate storages 30 with other capacities and cash boxes 12*e* with other remaining capacities may be used. It is however particularly advantageous when the maximum storage capacity of the intermediate storage 30 is equal to or up to 10% less than the initial remaining capacity of the cash box 12*e* after detection of the carriage 38 by the detector 42.

This initial remaining capacity is also referred to as initial value. If, after detection of the carriage 38 with the aid of the detector 42, at least still one further deposited note of value is assigned to the cash box 12*e* and transported thereinto, the remaining capacity of the cash box 12*e* is less by this note of value than the maximum capacity of the intermediate storage 30 so that in the prior art no further deposit operations are possible at the automated teller machine 10 since it is not guaranteed that all deposited banknotes can actually be accepted in the cash boxes 12*a* to 12*e*. This is in particular the case when, for example, the maximum number of banknotes accepted in the intermediate storage is deposited and all deposited banknotes then have to be stored in the cash box 12*e* due to their properties. As a result, the storage area provided in the cash box 12*e* for storing banknotes 40 cannot be utilized completely in the prior art.

Figures 1, 2:
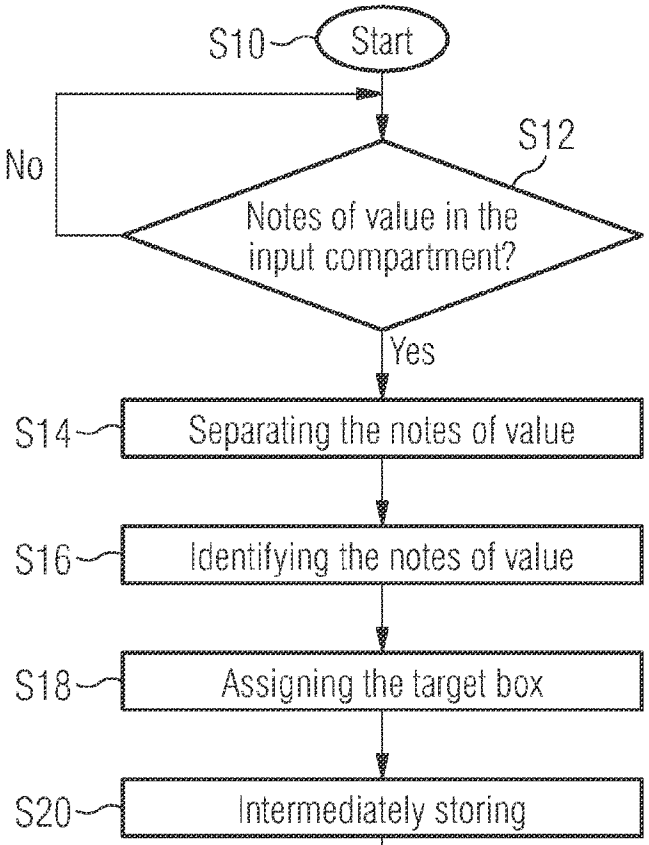
Figure 2:
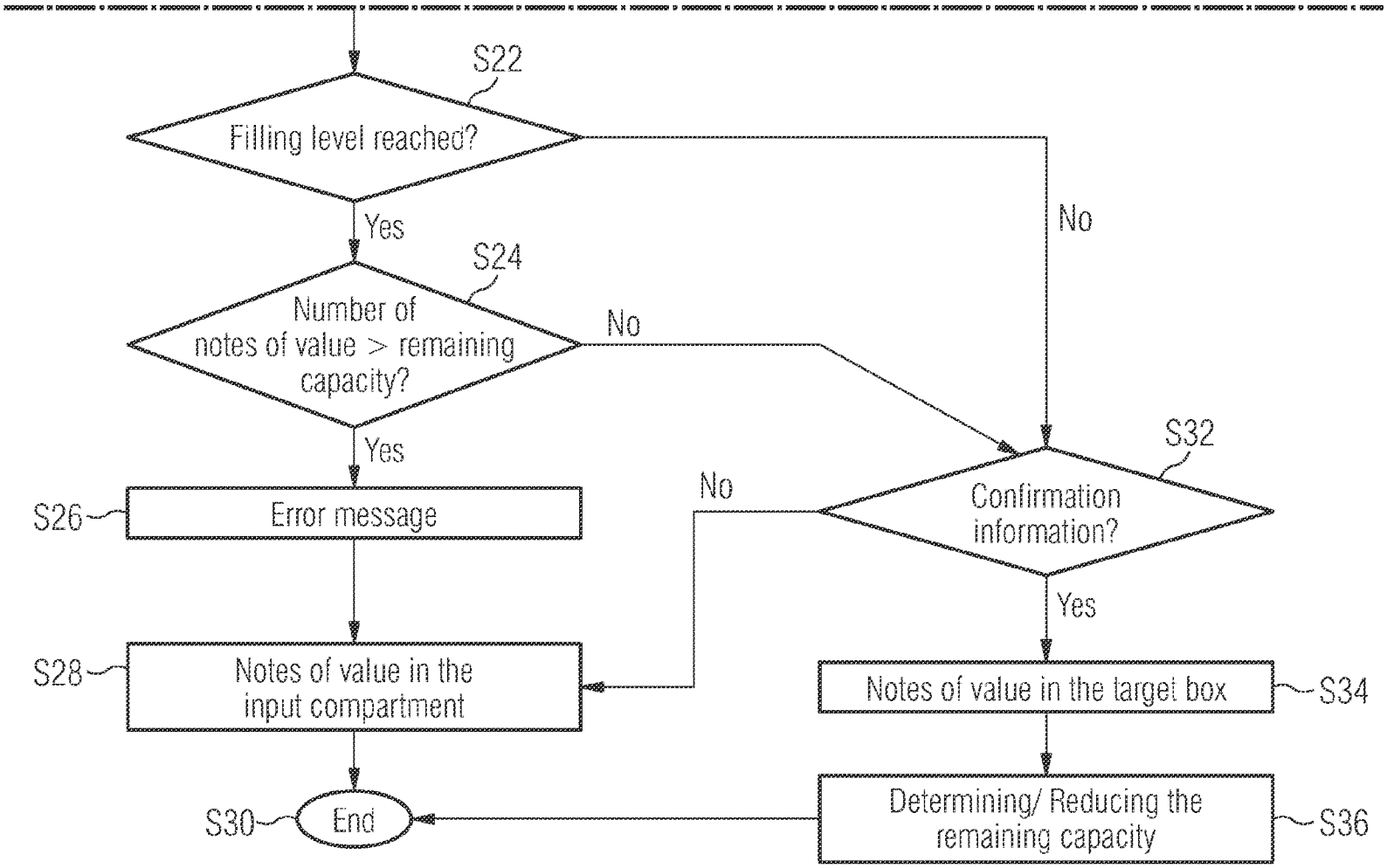

FIG. 2 shows a flow chart of a deposit operation at the automated teller machine 10 according to FIG. 1 according to a new method. In the following, deposited notes of value and checks and other depositable notes are referred to as notes of value. The same elements and elements having the same function are identified with the same reference signs.

The sequence is started in step S10. Subsequently, it is checked in step S12 whether notes of value 13, 40 are present in the input compartment 22. If this is not the case, then step S12 is repeated until notes of value 13, 40 are detected in the input compartment 22.

In other embodiments, the sequence may also be terminated when no notes of value 13, 40 are detected in the input compartment 22.

If notes of value had been detected in the input compartment 22, the sequence is continued in step S14 with the separation of the notes of value 13, 40 detected in the input compartment 22. Subsequently, the notes of value 13, 40 are fed to the banknote identification unit for identifying each one of the separated notes of value. Thereafter, in step S18, the control unit 28 assigns a target box 12*a* to 12*e* to each identified note of value. Subsequently, in step S20, the identified notes of value are stored in the intermediate storage 30. In other embodiments, the order of steps S18 and S20 may also be reversed.

After assigning the separated notes of value 13, 40 to a target box and intermediately storing the notes of value 13, 40 in the intermediate storage 30, it is checked in step S22 whether a predetermined filling level of the cash box 12*e* has already been reached. In the automated teller machine 10 according to FIG. 1, this is the case when the carriage 38 is detected by the detector 42. If this is the case, then subsequently it is checked in step S24 whether the number of notes of value 40 which the control unit 28 has assigned for storage in the cash box 12*e* is greater than the remaining capacity present in the cash box 12*e*, wherein the remaining capacity indicates the number of banknotes which may still be stored in the cash box 12*e*. If it is determined in step S24 that the number of notes of value assigned to box 12*e* is greater than the remaining capacity of the cash box 12*e*, an error message is output in step S26 via the input and output unit 36 and subsequently, in step S28, all notes of value 13, 40 stored in the intermediate storage 30 are again output into the input and output compartment 22. Subsequently, the sequence is terminated in step S30.

If it is, however, determined in step S24 that the number of notes of value assigned to box 12*e* is less than or equal to the remaining capacity of the cash box 12*e*, then it is checked in step S32 whether a user after display of the total sum of the deposited notes of value or a listing of the deposited notes of value or merely a request whether the deposit operation shall actually take place, inputs a confirmation information. If no confirmation information has been input or if a negative confirmation information has been input, then the sequence is continued in step S28 with the output of all notes of value intermediately stored in the intermediate storage 30 into the input and output compartment 22, and then terminated in step S30.

If it is, however, determined in step S32 that a confirmation information has been input, then the sequence is continued in step S34 and all notes of value present in the intermediate storage 30 are transported to the respective target box 12*a* to 12*e* and stored therein. Subsequently, in step S36 the remaining capacity of the cash box 12*e* is reduced by the number of notes of value transported into the cash box 12*e*, and the sequence is terminated in step S30.

In other embodiments, steps S34 and S36 may also be reversed or it may be checked for every note of value removed from the intermediate storage 30 whether this one is fed to the cash box 12*e* and the remaining capacity is step-wise reduced for each individual note of value.

If it is determined in step S22 that the predetermined filling level of the cash box 12*e* has not been reached yet, i.e. there is still enough remaining capacity in the cash box 12*e* that the entire number of notes of value intermediately stored in the intermediate storage 30 could be stored in the cash box 12*e*, the sequence is continued in step S32 by bypassing step S24. Here, in step S36 the remaining capacity is not necessarily reduced by the number of notes of value transported to the cash box 12*e* but it is checked upon feeding of each note of value whether the predetermined filling level of the cash box 12*e* has already been reached and only then the remaining capacity is reduced by the count value 1 for each further fed note of value. This is explained in the following in detail in the sequence of FIG. 3.

Figure 3:
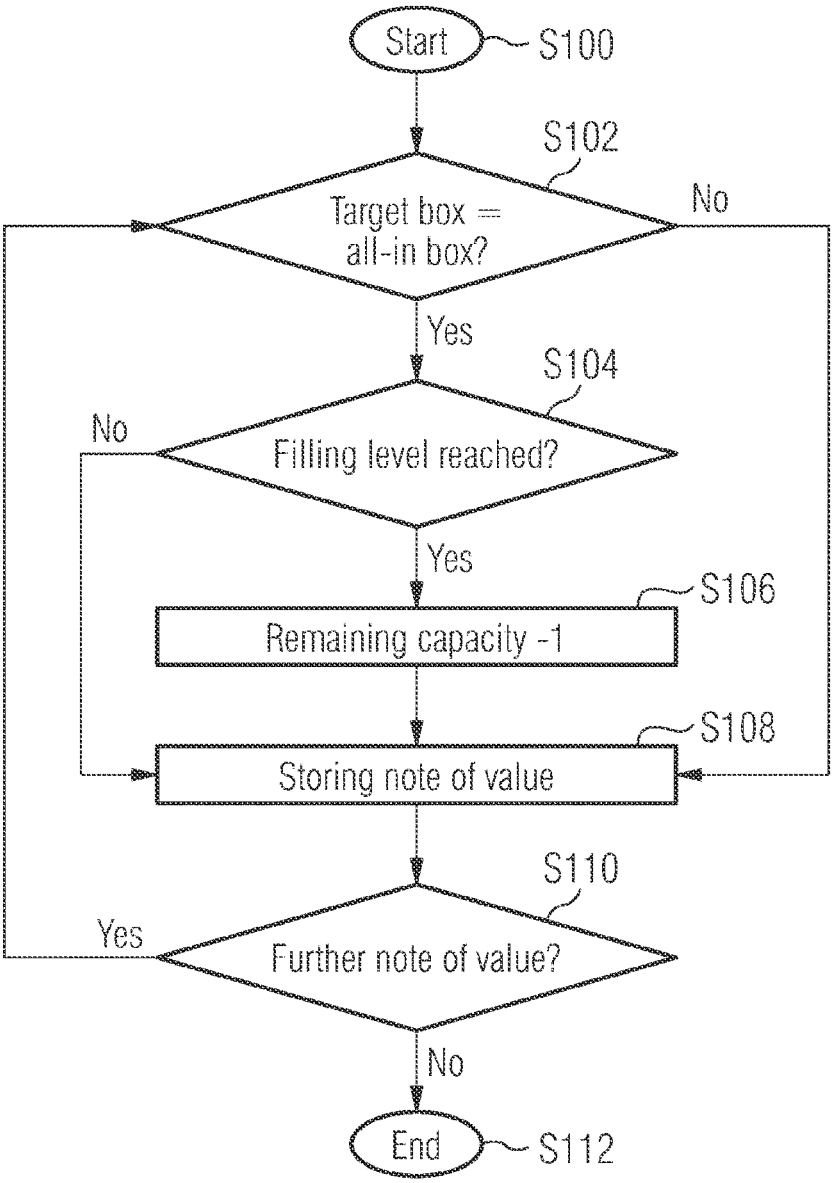
FIG. 3 shows a detailed flow chart of step S36 according to FIG. 2.

FIG. 3 shows a detailed flow chart of step S36 according to FIG. 2. The sequence is started in step S100. In step S102, for each note of value 13, 40 removed from the intermediate storage 30 it is checked whether the control unit 28 has assigned the note of value 13, 40 to the cash box 12*e*. If this is the case, then it is subsequently checked in step S104 whether the predetermined filling level detectable with the aid of the detector 42 has already been reached or exceeded. If this is the case, then subsequently in step S106 a stored initial remaining capacity of the cash box 12*e* is reduced by the value 1. From this, there results a remaining capacity that indicates the number of banknotes which may still be accepted in the cash box 12*e*. Subsequently, the note of value 40 is transported into the cash box 12*e* in step S108. Subsequently, in step S110 it is checked whether further intermediately stored notes of value 40 are present in the intermediate storage 30. If this is the case, then the sequence is continued in step S102 and the check is performed once again with the next note of value 40 to be removed from the intermediate storage 30. If it is, however, determined in step S110, that no further notes of value are stored in the intermediate storage, then the sequence is terminated in step S112.

If it is however determined in step S104 that the predetermined filling level value of the cash box 12*e* has not been reached yet, the sequence is continued in step S108, as described, by bypassing step S106.

Figure 4:
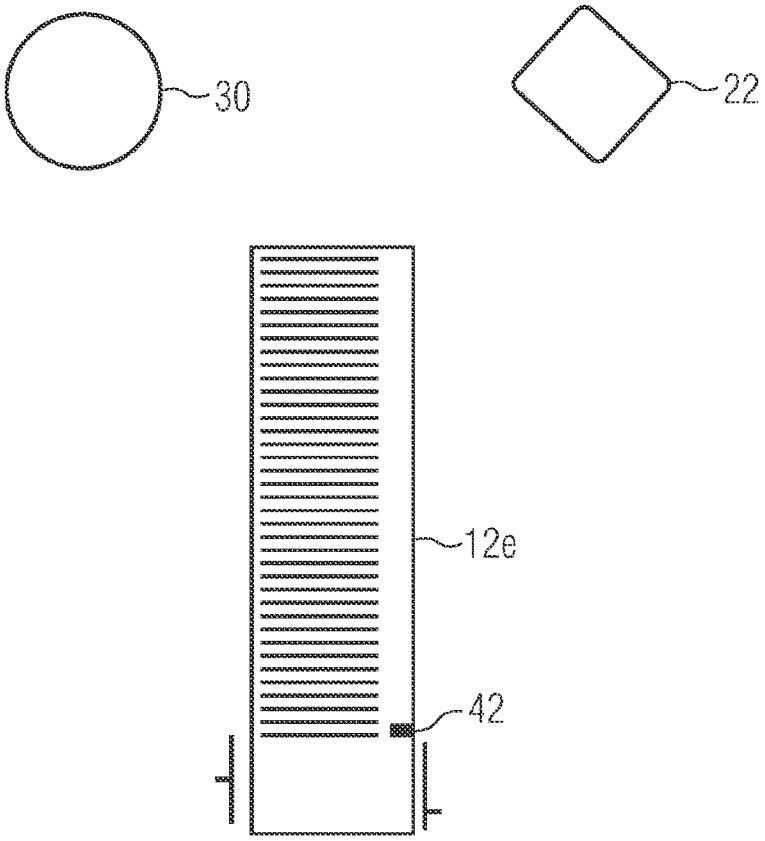
FIG. 4 shows a schematic illustration of an input compartment, an intermediate storage and a cash box when using a method according to the prior art.

FIG. 4 shows a schematic illustration of the input compartment 22, the intermediate storage 30 and the cash box 12*e*, when using a method for depositing notes of value according to the prior art. After so many notes of value 40 have been stored in the cash box 12*e* that the detector 42 detects that the predetermined filling level has been reached, the automated teller machine 10 is blocked for further deposit operations. Thus, no further notes of value may be placed in the input compartment and be deposited as described above, since it can no longer be guaranteed that the further deposited notes of value can be stored in the cash box 12*e*. As already explained in connection with FIG. 1, the remaining capacity in the cash box 12*e* is so high after the detector 42 has been triggered that the cash box 12*e* may accept the maximum number of notes of value that can intermediately be stored in the intermediate storage 30. This is no longer the case when already a further note of value in a further deposit operation is transported into the cash box 12*e* and stored therein. In the worst case, the entire remaining capacity of, for example, 399 banknotes remains unused. When reaching the predetermined filling level or when exceeding the same, the actual deposit operation is still terminated in the prior art and then the automated teller machine 10 is blocked for further deposit operations or is taken out of service.

Figure 5:
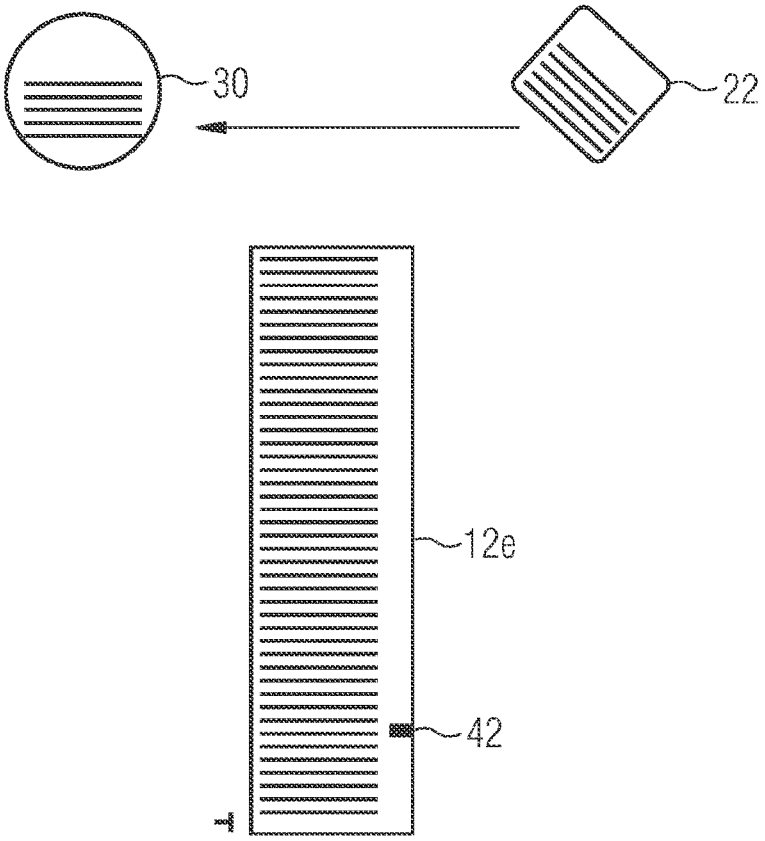
FIG. 5 shows the schematic illustration of the input compartment, the intermediate storage and the cash box according to FIG. 4 when using a new method.

FIG. 5 shows a schematic illustration of the input compartment 22, the intermediate storage 30 and the cash box 12*e* according to FIG. 4 when using the method described in connection with FIGS. 2 and 3. Even after detecting the reaching of the predetermined filling level by the detector 42, further deposit operations are allowed. For this, further notes of value may be placed in the input and output compartment 22, separated, checked with the aid of the value note identification unit 26, and stored in the intermediate storage 30. The control unit 28 determines the current remaining capacity based on the initial remaining capacity after reaching the predetermined filling level by detection with the aid of the detector 42, as this has already been explained in connection with FIGS. 2 and 3, in that after reaching the predetermined filling level the remaining capacity of the cash box 12*e* indicated by a number of notes of value is reduced by 1 with the feeding of a note of value into the cash box 12*e*. Dependent on the result of the value note identification unit 26, the control unit 28 assigns a target box 12*a* to 12*e* to each identified note of value 13, 40. After reaching the predetermined filling level, the control unit 28 further checks whether the number of all notes of value 13, 40 checked by the value note identification unit 26 and intermediately stored in the intermediate storage 30, and to which the cash box 12*e* is assigned as a target box, exceeds the remaining capacity. Only in this case, the deposit operation is aborted, and the notes of value 13, 40 are again output from the intermediate storage 30 to the user via the input and output compartment 22. Alternatively, it can be indicated to the user that only those notes of value 13, 40 no longer acceptable in the cash box 12*e* are again output and the other notes of value 13, 40 may be kept as deposit. When the user confirms this, the notes of value 40 not acceptable by the cash box 12*e* can again be output via the input and output compartment 22, and the other notes of value 40 can be transported to the boxes 12*a* to 12*e* and stored therein.

The invention claimed is:

1. A device for handling notes of value comprising:

an input compartment configured to receive a plurality of notes of value from a user for deposit;

a value note identification unit configured to identify each of the plurality of notes of value received in the input compartment including identifying respective values of each of the plurality of notes of value;

an intermediate storage unit configured to intermediately storing the identified and inputted plurality of notes of value;

a first cash box for storing a first one or more of the identified and inputted plurality of notes of value after the first one of more of the identified and inputted plurality of notes of value was intermediately stored in the intermediate storage unit;

a second cash box for storing a second one or more of the identified and inputted plurality of notes of value after the second one of more of the identified and inputted plurality of notes of value were intermediately stored in the intermediate storage unit, the second cash box being an all-in cash box and configured to store notes of value having a poor quality including wavy notes;

a transport unit for transporting the identified and inputted plurality of notes of value among the input compartment, the intermediate storage unit, the first cash box, and the second cash box;

a detector element disposed in the second cash box;

an input and output unit;

a control unit configured to:

assign to the second cash box as a target cash box a first number value of the identified and inputted plurality of notes of value for transport by the transport unit from the intermediate storage unit, determine whether a filling level of the second cash box has reached or exceeded a predetermined value by receiving a signal from the detector element, determine a current remaining capacity value of the second cash box in that the control unit deducts a second number value of the notes of value that were transferred to the second cash box after the filling level of the second cash box was reached or exceeded from an initial remaining capacity value of the second cash box, determining that a first portion of the number of the plurality of notes is equal to the remaining capacity and a second portion of the number of the plurality of notes is beyond the remaining capacity;

control the input and output unit to indicate, to the user, that the second portion of the number of the plurality of notes cannot be deposited;

control the input and output unit to receive a first confirmation corresponding to an acceptance of the user to deposit the first portion of the number of the plurality of notes, and control the transport unit to move the first portion of the number of the identified and inputted plurality of notes of value that are presently stored in the intermediate storage unit and to the second cash box in response to receiving the first confirmation; and a carriage positioned in second cash box to receive notes to lay face down or face up and the carriage movable vertically downward during filling of the second cash box, wherein the detector element is positioned in the second cash box such that the detector element detects the carriage when ninety percent of the initial remaining capacity value of the second cash box has been consumed.

2. The device according to claim 1 wherein the detector element comprises a light barrier arrangement.

3. The device according to claim 1 wherein notes of value stored in the first cash box stand on one of their edges.

4. The device according to claim 1 wherein a maximum number of notes storable in the intermediate storage unit is less than a remaining capacity of the second cash box at the time the predetermined value is reached.

5. The device according to claim 1 further comprising:

a pull-off and separating unit for separating notes of value inputted to the input compartment, wherein the transport unit feeds the separated notes of value to the value note identification unit individually one after the other.

6. The device according to claim 1, further comprising: a drive unit, wherein the control unit is configured to control the drive unit for displacing the carriage dependent on a height of the value note stack, wherein the detector element determines that the filling level of the second cash box has reached the predetermined value when the carriage is detected by the detector element.

7. A method for operating a device for handling notes of value comprising:

receiving, in an input compartment of the device, a plurality of notes of value from a user for deposit;

identifying, with a value note identification unit of the device, each of the plurality of notes of value after said receiving;

intermediately storing, in an intermediate storage unit of the device, the plurality of notes of value after said identifying;

assigning, with a control unit of the device, a first number value of the plurality of notes for storage to a second cash box of the device after said intermediately storing, the second cash box being an all-in cash box and configured to store notes of value having a poor quality including wavy notes;

determining, with the control unit, a filling level of the second cash box has reached a predetermined value by receiving a signal from a detector element of the device disposed in the second cash box;

determining, with the control unit, a current remaining capacity value of the second cash box by deducting a second number value of notes of value that were transported to the second cash box after the filling level of the second cash box was reached from an initial remaining capacity value of the second cash box;

determining, with the control unit, that a first portion of the number of the plurality of notes is equal to the remaining capacity and a second portion of the number of the plurality of notes is beyond the remaining capacity;

indicating, with an input and output unit of the device, to the user, that the second portion of the number of the plurality of notes cannot be deposited;

receiving, through the input and output unit of the device, a first confirmation corresponding to an acceptance of the user to deposit the first portion of the number of the plurality of notes;

feeding, with a transport unit of the device, the first portion of the number of the plurality of notes to the second cash box from the intermediate storage unit only in response to said receiving the first confirmation;

placing the first portion of the number of the plurality of notes to lay face down or face up on a carriage positioned in second cash box;

moving the carriage vertically downward during filling of the second cash box; and positioning the detector element in the second cash box such that the detector element detects the carriage when ninety percent of the initial remaining capacity value of the second cash box has been consumed.

* * * * *